US011179011B2

(12) United States Patent
Elliott et al.

(10) Patent No.: US 11,179,011 B2
(45) Date of Patent: Nov. 23, 2021

(54) MECHANISM, ASSEMBLY AND SHEET MATERIAL DISPENSER FOR MANUALLY ACTUATING ROTATION OF A ROLLER

(71) Applicant: Essity Hygiene and Health Aktiebolag, Gothenburg (SE)

(72) Inventors: Adam T. Elliott, Lexington, KY (US); Mark W. Henson, Danville, KY (US)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 151 days.

(21) Appl. No.: 16/647,208

(22) PCT Filed: Sep. 15, 2017

(86) PCT No.: PCT/EP2017/073350

§ 371 (c)(1),
(2) Date: Mar. 13, 2020

(87) PCT Pub. No.: WO2019/052662

PCT Pub. Date: Mar. 21, 2019

(65) Prior Publication Data

US 2020/0214513 A1 Jul. 9, 2020

(51) Int. Cl.

| | |
|---|---|
| ***A47K 10/36*** | (2006.01) |
| ***B65H 16/00*** | (2006.01) |
| ***B65H 16/06*** | (2006.01) |

(52) U.S. Cl.

CPC ..... *A47K 10/3637* (2013.01); *B65H 16/005* (2013.01); *B65H 16/06* (2013.01)

(58) Field of Classification Search

None

See application file for complete search history.

(56) References Cited

U.S. PATENT DOCUMENTS

| | | | |
|---|---|---|---|
| 3,107,957 | A | 10/1963 | Batlas et al. |
| 3,924,476 | A | 12/1975 | Wolcott |

(Continued)

FOREIGN PATENT DOCUMENTS

| | | | |
|---|---|---|---|
| CN | 101091629 | A | 12/2007 |
| CN | 102231960 | A | 11/2011 |
| CN | 102905593 | A | 1/2013 |

(Continued)

OTHER PUBLICATIONS

Swedish Patent and Registration Office (PRV), Novelty Search Report dated May 8, 2017 (7 pages).

(Continued)

*Primary Examiner* — William A. Rivera

(74) *Attorney, Agent, or Firm* — Wood Herron & Evans LLP

(57) ABSTRACT

A mechanism is provided for manually actuating rotation of a roller of a sheet material dispenser for dispensing a predetermined length of sheet material. The mechanism includes a frame member; a driven member configured for coupling with the roller; an actuating member configured to rotate about a rotation axis in a first direction through manual actuation by a user; and a driver member coupled with the actuating member. The rotation axis is movably mounted on the frame member to be movable between a first position allowing rotation of the roller caused by rotation of the actuating member in the first direction, and a second position preventing rotation of the roller caused by rotation of the actuating member in the first direction. The mechanism includes a first urging member configured to urge the rotation axis in the first position. A related assembly and dispenser including the mechanism are also provided.

19 Claims, 6 Drawing Sheets

(56) References Cited

U.S. PATENT DOCUMENTS

| | | | | |
|---|---|---|---|---|
| 4,192,442 | A | 3/1980 | Bastian et al. | |
| 4,579,268 | A | 4/1986 | Cornell | |
| 5,375,785 | A * | 12/1994 | Boone | A47K 10/26 242/560.1 |
| 5,924,617 | A * | 7/1999 | LaCount | A47K 10/3687 225/16 |
| 6,206,322 | B1 * | 3/2001 | Elliott | A47K 10/36 192/17 R |
| 7,040,566 | B1 | 5/2006 | Rodrian et al. | |
| 7,347,134 | B2 * | 3/2008 | Lewis | A47K 10/36 225/10 |
| 10,932,628 | B2 * | 3/2021 | Budz | A47K 10/3637 |
| 2003/0164079 | A1 * | 9/2003 | Budz | A47K 10/36 83/649 |
| 2006/0138274 | A1 * | 6/2006 | Goeking | A47K 10/36 242/564.4 |
| 2011/0095063 | A1 * | 4/2011 | Hagleitner | A47K 10/3612 226/188 |
| 2012/0273605 | A1 * | 11/2012 | Keily | A47K 10/3637 242/564.2 |
| 2017/0188760 | A1 * | 7/2017 | Henson | A47K 10/38 |
| 2019/0014956 | A1 * | 1/2019 | Chang | A47K 10/38 |

FOREIGN PATENT DOCUMENTS

| | | | |
|---|---|---|---|
| CN | 103068289 | A | 4/2013 |
| CN | 203714943 | U | 7/2014 |
| CN | 204541908 | U | 8/2015 |
| CN | 105916423 | A | 8/2016 |
| EP | 0010404 | A1 | 4/1980 |
| EP | 2916023 | A1 | 9/2015 |

OTHER PUBLICATIONS

Canadian Intellectual Property Office, Examiner's Report, Application No. 3,073,769, dated Apr. 21, 2021 (4 pages).

National Intellectual Property Administration (CNIPA) of the People's Republic of China, Office Action, Application No. 201780094820.3, dated Apr. 27, 2021 (20 pages).

International Searching Authority, Search Report and Written Opinion issued in International Application No. PCT/EP2017/073350 dated May 29, 2018 (13 pages).

* cited by examiner

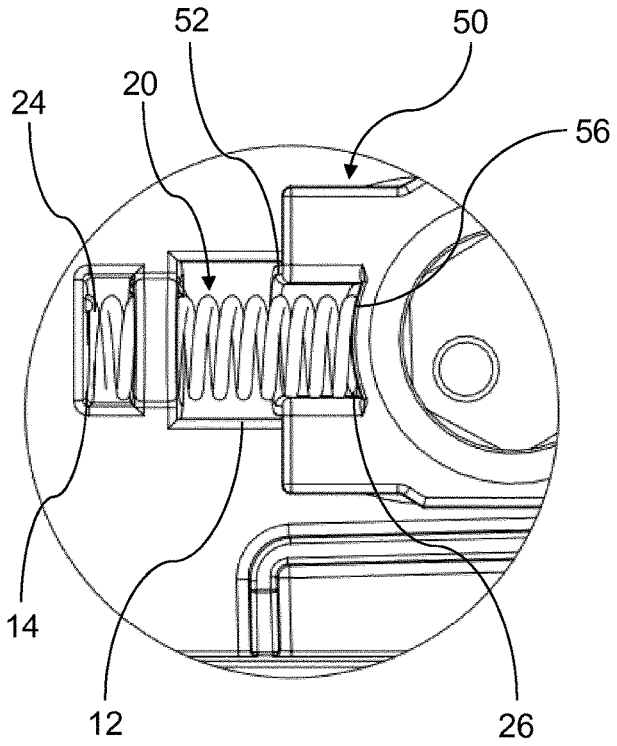
Fig. 4C
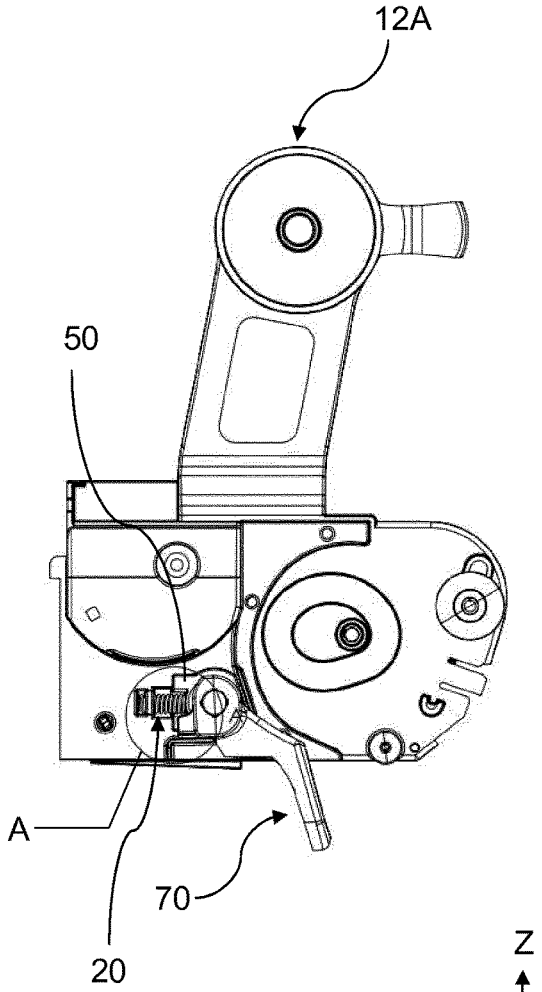
Fig. 4B
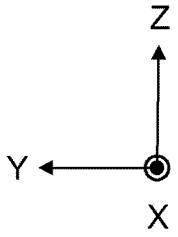

MECHANISM, ASSEMBLY AND SHEET MATERIAL DISPENSER FOR MANUALLY ACTUATING ROTATION OF A ROLLER

CROSS-REFERENCE TO RELATED APPLICATION

This application is a national phase entry of, and claims priority to, International Application No. PCT/EP2017/073350, filed Sep. 15, 2017. The above-mentioned patent application is incorporated herein by reference in its entirety.

TECHNICAL FIELD

This application relates to the technical field of dispensers for dispensing sheet materials, such as hygienic tissue papers, facial tissues, paper towels, toilet paper, paper wipes and other kinds of tissue paper or other materials for use in domestic, public and private premises.

BACKGROUND

Apparatuses for dispensing sheet materials are widely used. These dispensers are often of the type that include a housing that internally accommodates a drum that receives a cutting device which is articulated relative to the drum and during rotation of the latter; the drum is positioned between support side pieces. The roll of material may be positioned adjacent or resting on the drum, or between support side pieces above in the upper part of the housing. A roller is used to press a web of material from the roll against the drum and allows transport of the web of material towards the back of the apparatus in order to allow completely safe cutting of the web of material, by above-mentioned cutting device, to a predetermined size. The rolls of material may be coreless or have a core that supports the turns of material tightly wound in accordance with the characteristics of the material and market in question. Dispensers of the type discussed above may be electrically operated automatic or semi-automatic dispensers, where the dispensing of sheet material is initiated by a sensor detecting a user in the proximity of a predetermined portion of the dispenser. Alternatively, the dispensing of sheet material may be manually initiated by a user pressing a button or similar to actuate.

These types of sheet material dispensers are generally installed in areas accessible to the public, in areas for company staff or on premises of public sector or private establishments. In addition, these dispensers require maintenance operations, not only to ensure their refilling when the roll of material is exhausted, but also when a tail of the material is confined to an inside of the housing and thus not accessible to the end user, as a result of a previous dispensing operation. This issue is likely to result from a paper jam, a load of an excessive wad of paper, or other sources of blocking within the dispenser, which cause the paper tissue material to tear inside the housing, instead of being cut by the cutting device in order to allow the end user from accessing to the tail of the material.

Unblocking of the material may require exerting an actuation force on an actuation mechanism of the dispenser that exceeds a breaking load of some of the internal parts of the mechanism, such as gear elements, which may form part of the dispensers. Such a breakage may, for example, occur in situ, since there is no control on the forces exerted by the end users or maintenance personnel on the actuation mechanism. Some have sought to address this problem by providing the actuation mechanism with a protective arrangement that isolates sensitive components of the mechanism from the forces exerted by end users when such forces exceed a predetermined threshold. As used herein, the term "user" indifferently refers to end users, maintenance personnel and other persons that may come in contact with a dispenser.

In dispensers that include protective arrangements of the type described above, however, problems have been observed with the level of resistive forces generated within the dispenser, which result in abrupt transitions between different states of the dispenser. These abrupt transitions may result in premature failure of components within the dispenser.

It would be desirable, accordingly, to provide a mechanism, an assembly including the same, a dispenser included the same and associated methods that address the drawbacks discussed above and result in improved dispenser durability and reliability.

SUMMARY

To address these and other problems with conventional dispenser designs, a mechanism is provided according to embodiments of this invention for manually actuating rotation of a roller of a sheet material dispenser for dispensing a predetermined length of sheet material. The mechanism includes a frame member configured for attachment to a housing of the dispenser, a driven member configured for coupling with the roller, an actuating member configured to rotate about a rotation axis in a first direction through manual actuation by a user, and a driver member coupled with the actuating member. The rotation axis is movably mounted on the frame member so as to be movable between a first position in which the driver member and the driven member are connected to one another to allow rotation of the roller caused by rotation of the actuating member in the first direction, and a second position in which the driver member and the driven member are disconnected from one another to prevent rotation of the roller caused by rotation of the actuating member in the first direction. The mechanism also includes a first urging member configured to urge the rotation axis in the first position.

In such embodiments, the actuating member is movable relative to the frame member, in addition to being rotatable about the rotation axis. Furthermore, the first urging member applies an urging force on the rotation axis, which prevents the rotation axis from moving from the first position, when the user force is low enough to not overcome this urging force. Thus, when the user force is low enough so as not to overcome the urging force, the user force causes rotation of the actuating member about the rotation axis that is opposed by the resistive force applied by the driven member connected with the driver member. Conversely, when the user force is high enough to overcome the urging force, the user force causes movement of the rotation axis toward the second position, against the urging force of the first urging member, which disconnects the driven and driver members and removes the resistive force applied by the driven member. Therefore, the user force applied on the actuating member is opposed by an adverse force irrespective of whether the user force overcomes or not the urging force. Accordingly, the transition between the transmission and non-transmission states of the user force to the driven member may be smoothed. In addition, by suitably adapting the first urging member, the urging force may further smooth this transition. Also, since this transition is made via the addition of a second movement of the actuating member, in addition to its rotation around of the rotation axis, this transition may repeatedly occur with a decreased risk of early failure of the mechanism.

In the present disclosure, the expression "actuating member" refers to any member suitable for being manually actuated by a user and configured to rotate about a rotation axis.

In one embodiment, the rotation axis may be movably mounted directly on the frame member. This implementation may be desirable to impart simplicity of structure to the mechanism. For example, the rotation axis may take the form of at least one pivot movably mounted in a respective moving path of the frame member so as to be movable between the first and second positions. For example, the moving path may be formed by an elongated opening, slot, recess or the like of the frame member.

In another embodiment, the mechanism may include a mobile member through which the rotation axis is movably mounted on the frame member. This implementation may be desirable for more design flexibility.

In a further embodiment, the actuating member may be configured to rotate around the mobile member, and the mobile member may be movably mounted on the frame member so as to allow movement of the rotation axis between the first and second positions. For example, the rotation axis may take the form of at least one pivot rigidly attached to or integrally formed with the mobile member. This configuration is desirable to impart simplicity while allowing use of a mobile member. Alternatively, the rotation axis may take the form of at least one pivot movably mounted on the mobile member. Thus, design flexibility may be further increased.

In yet another embodiment, one of the mobile member and frame member may include a guided portion, and the other one of the mobile member and frame member may include a guiding portion configured to cooperate with the guided portion to guide movement of the mobile member between the first and second positions. Implementing cooperation between guided and guiding portions defines a movement path for the mobile member between the first and second positions.

In one embodiment, the first urging member may be arranged to exert an urging force directly on the rotation axis so as to urge the rotation axis in the first position. In some other arrangements, the first urging member may be arranged to exert an urging force on any one the driver member, the actuating member and the mobile member (when included in the mechanism) so as to indirectly urge the rotation axis in the first position.

Furthermore, in some embodiments, the coupling between the actuating member and the driver member may be configured to enable the driver member to move the driver member away from the driven member in order to disconnect the driven and driver members, when the rotation axis is being moved from the first position to the second position. Also, in some arrangements, the coupling between the actuating member and the driver member may be configured to enable the driver member to move the driver member into engagement or contact with the driven member in order to connect the driven and driver members, when the rotation axis is being moved from the second position to the first position.

In another embodiment, the rotation axis may be slidably movable between the first and second positions. Implementation of a sliding movement may be desirable to impart simplicity of operation to the mechanism.

In a further embodiment, the rotation axis may be arranged to move between the first and second positions along a trajectory contained in a plane perpendicular to the orientation of the rotation axis in the first position. This particular trajectory provides a smooth transition between the user force transmission state, in which only the actuating member is rotatable, and the user force non-transmission state, in which the rotation axis is movable.

In yet another embodiment, the first position may be arranged to be closer to the driven member than is the second position, and the actuating member may be arranged to rotate away from the driven member when rotating in the first direction.

In one embodiment, the first urging member may include at least one spring, in particular a metallic one. The transition between the user force transmission and non-transmission states might concentrate stress on the first urging member in the first place. Thus, it may be desirable to use at least one spring, which is a long life element, especially when made of metal. Also, in some arrangements, the at least one spring of the first urging member may be arranged to exert an urging force through a compression and/or an extension and/or a torsion and/or another kind of deformation of the at least one spring. In particular, the at least one spring of the first urging member may be a compression spring, an extension spring, a torsion spring, or a spring with another design. Furthermore, in some arrangements, the first urging member may include a plurality of springs, for instance two or more, arranged spaced apart from each other, in particular along the direction of the rotation axis.

In another embodiment, the at least one spring may include a first end arranged to contact a surface of the frame member, and a second end arranged to contact a surface of the mobile member (when included). Thanks to this configuration, the at least one spring may be easily assembled and replaced.

In yet another embodiment, the driven member may include a first gear member, the driver member may include a second gear member, and the driven and driver members may be respectively connected to and disconnected from one another through a meshing engagement movement and a meshing disengagement movement of the second gear member relative to the first gear member. Thanks to this configuration, the driven member may be efficiently driven by the driver member when connected together, while allowing easy connections and disconnections of the driven and driver members.

In a further embodiment, the driver member and the actuating member may be rigidly coupled to one another in rotation. The mechanism may be accordingly simplified. Alternatively, the driver member and the actuating member may be coupled so that a movement of the driver member resulting from movement of the rotation axis between the first and second positions ultimately causes movement of the driven member, while allowing relative movement between the driver member and the actuating member. This alternative configuration may be used, for example, in order to optimize mechanical performance of the mechanism. More generally, the driver member and actuating member may remain coupled to each other irrespective of the user force exerted on the actuating member.

In one embodiment, the driver member and the actuating member may be formed as separate elements. Alternatively, the driver member and the actuating member may be integrally formed as a single element. In this case, the driver member and actuating member cannot be dissembled from each other.

In another embodiment, the mechanism may include a second urging member distinct from the first urging member and configured to urge the actuating member in a second direction of rotation opposite the first direction. Thus, the actuating member can automatically return to a rest position, in which the user does not exert a force thereon.

In a further embodiment, the second urging member may include at least one spring, in particular a metallic one. Also, in some arrangements, the at least one spring of the second urging member may be arranged to exert an urging force through a compression and/or an extension and/or a torsion and/or another kind of deformation of the at least one spring. In particular, the at least one spring of the second urging member may be a compression spring, an extension spring, a torsion spring, or a spring with another design. Furthermore, in some arrangements, the second urging member may include a plurality of springs, for instance two or more, arranged spaced apart from each other, in particular along the direction of the rotation axis.

In yet another embodiment, the second urging member may be configured to directly urge the actuating member in the second direction of rotation. In some other arrangements, the second urging may be arranged so as to urge the driver member or the rotation axis so as to indirectly urge the actuating member in the second direction of rotation.

In one embodiment, the first urging member may be further configured to urge the actuating member in a second direction of rotation opposite the first direction. Thus, in addition to being configured to urge the rotation axis in the first position, the first urging member can simultaneously perform a second function of urging the actuating member to return to a rest position.

In another embodiment, the actuating member may include a push bar arranged to be pushed by the user in order to rotate the actuating member in the first direction. This configuration has the advantage of enabling the user to exert a force on the actuating member in an effortless manner.

An assembly is provided in accordance with further embodiments of this invention, the assembly having a roller and a mechanism similar to those of the mechanism embodiments described above. Such assembly according to these embodiments is accordingly able to provide the same advantages as those described in connection with the mechanism embodiments.

A sheet material dispenser is provided in accordance with still further embodiments, the dispenser having a housing, a roller, and a mechanism similar to those described above. Such dispenser according to these embodiments is accordingly able to provide the same advantages as those described in connection with the mechanism embodiments.

The dispenser may be arranged for dispensing sheet materials, such as hygienic tissue paper, facial tissue, paper towels, toilet paper, paper wipes and other kinds of tissue paper or other materials for use in domestic, public and private premises. Also, the dispenser may be arranged for dispensing sheet materials from a material strip to be incorporated in the dispenser in a rolled configuration, with or without central core, or in a folded configuration.

Further features of, and advantages with, the present invention will become apparent when studying the following detailed description. Those skilled in the art will realize that different features of the present invention may be combined to create embodiments other than those described in the following, without departing from the scope of the present invention.

BRIEF DESCRIPTION OF THE DRAWINGS

The present disclosure will be described in detail with reference to the attached figures. It is to be understood that the drawings are designed solely for the purpose of illustration and are not intended as a definition of the limits of the present disclosure, for which reference should be made to the appended claims. It should be further understood that the drawings are not necessarily drawn to scale and that, unless otherwise indicated, they are merely intended to schematically illustrate the structures and methods described herein. The accompanying drawings, which are incorporated in and constitute a part of this specification, illustrate one or more embodiments of the invention and, together with the general description given above and the detailed description given below, explain the one or more embodiments of the invention.

FIG. 4B is an opposite side view of the mechanism shown in FIG. 4A.

FIG. 4C is an enlarged view of detail A of FIG. 4B.

DETAILED DESCRIPTION

First Embodiment

Figure 1A:
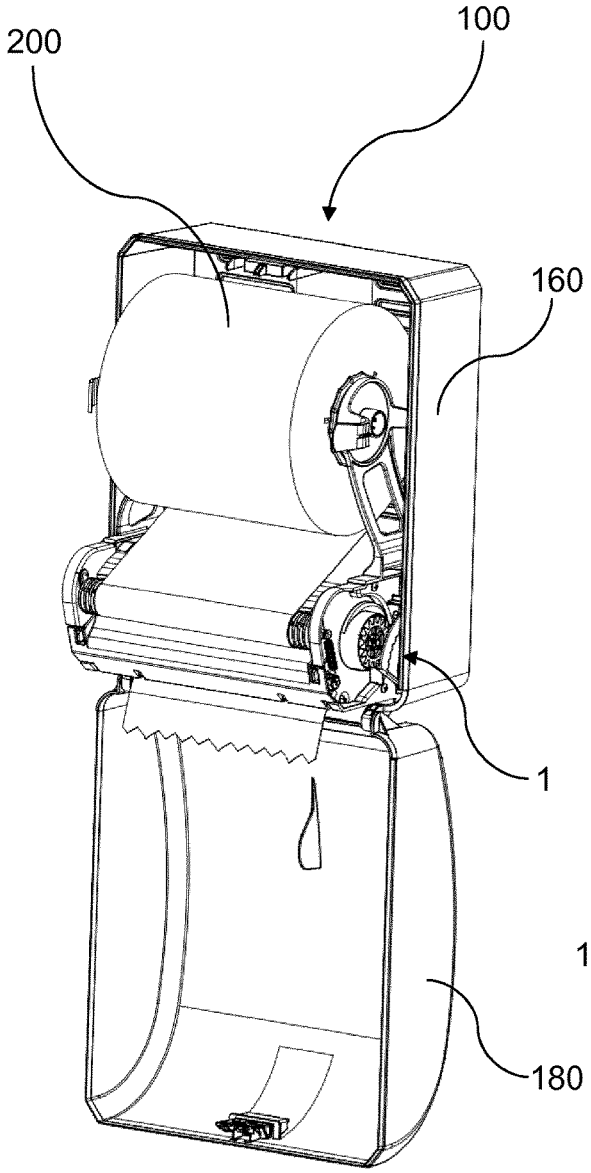
FIG. 1A is a top perspective view of a dispenser according to a first embodiment, showing a cover thereof in an opened position.
Figure 1B:
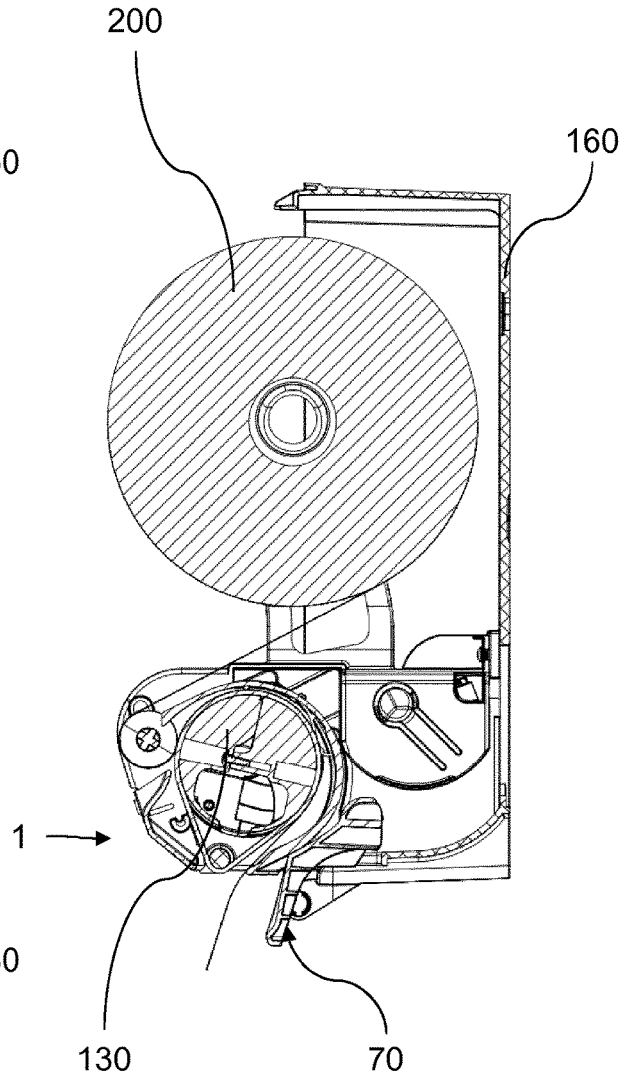
FIG. 1B is a side cross sectional view of the dispenser of FIG. 1A.
Figure 2:
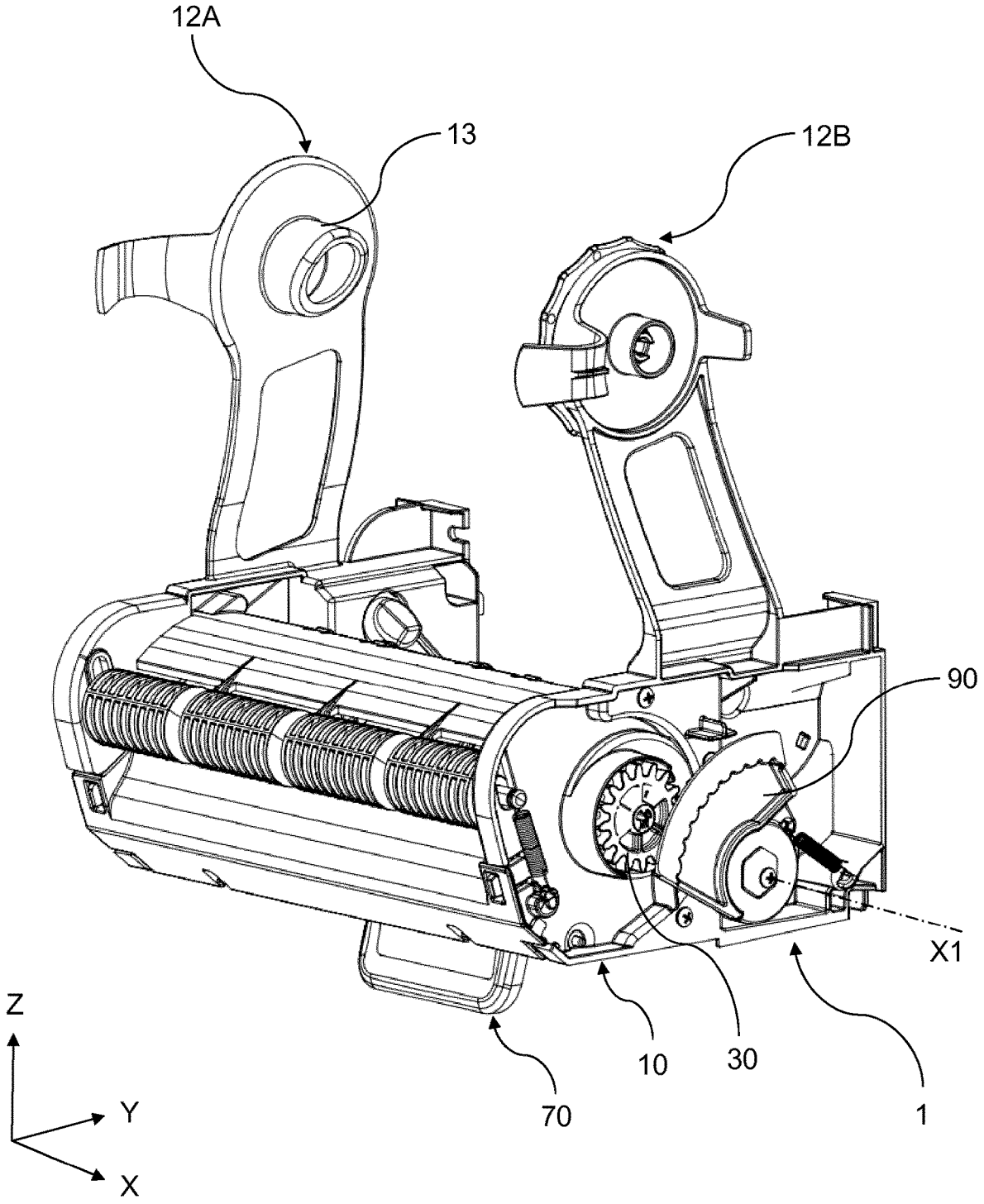
FIG. 2 is a perspective view of a mechanism used with the dispenser of FIGS. 1A and 1B.

FIGS. 1A and 1B schematically illustrate a sheet material dispenser 100 for dispensing sheet material according to a first embodiment of the present disclosure. Dispenser 100 includes a housing, a roller 130, and a mechanism 1 for manually actuating rotation of the roller 130, which is depicted in more detail in FIGS. 2 to 5C.

In this example, the housing has a casing 160 and a cover 180 that is mounted on the casing 160 so as to be movable between an opened position for maintenance (shown on FIG. 1A) and a closed position for an end user use.

In this example, a strip of the material to be dispensed is incorporated into the dispenser 100 and supplied in a rolled configuration forming a roll 200 which, in this example, has a central core. More specifically, in this example, the mechanism 1 has two arms 12A, 12B, both extending from the frame member 10, and having respective sleeves 13 for insertion into the central core of the roll 200.

In this example, the mechanism 1 is suitable for dispensing a predetermined length of sheet material, by manually actuating rotation of the roller 130. The mechanism 1 has a frame member 10 configured for attachment to the housing, and more specifically the casing 160 of the housing in this example. The frame member 10 is configured to be stationary with respect to the housing, when the frame member 10 is attached to the housing.

Also, the mechanism 1 has a driven member 30 configured for coupling with the roller 130. In this example, the driven member 30 and the roller 130 are configured to be rigidly coupled to one another during movement, and more specifically during rotation. However, without departing from the scope of the present disclosure, the driven member 30 and the roller 130 may alternatively be configured to be coupled in movement, particular in rotation, while allowing relative movement with respect to each other.

Figure 4A:
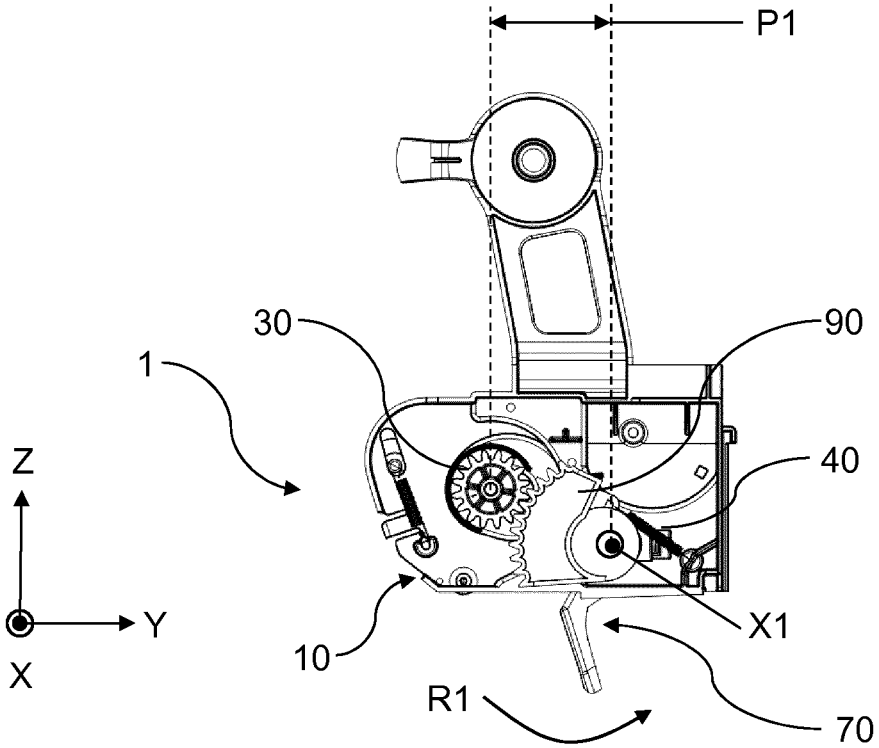
FIG. 4A is a side view similar to FIG. 3, showing the actuating member being moved away from the rest position.
Figure 5A:
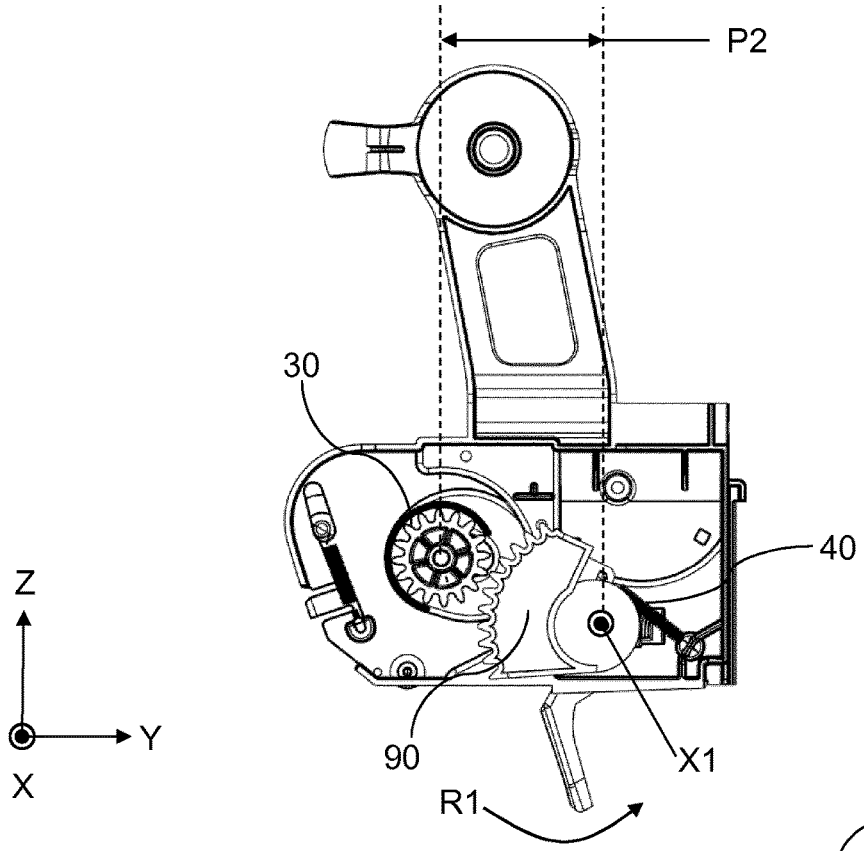
FIG. 5A is a side view similar to that of FIG. 4A, showing the actuating member being moved even farther away from the rest position.
Figure 5C:
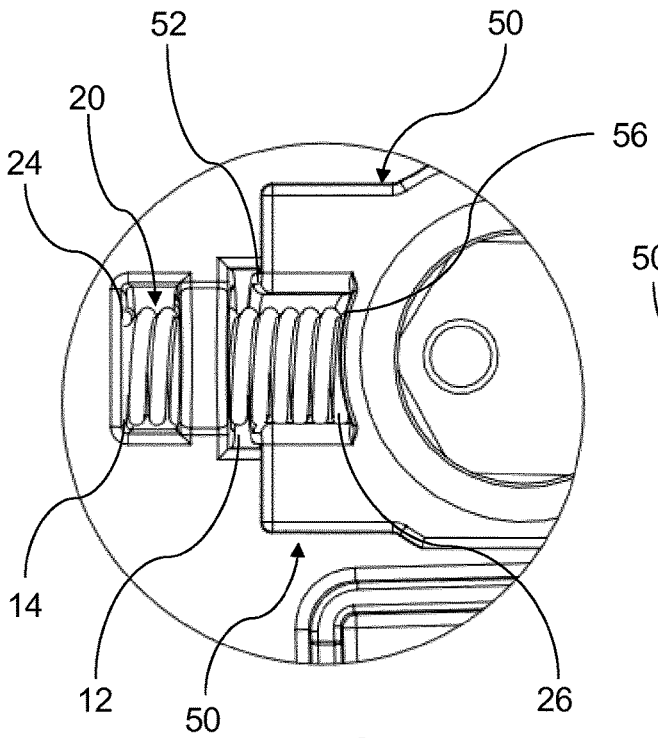
FIG. 5C is an enlarged view of detail B of FIG. 5B.
Figure 5B:
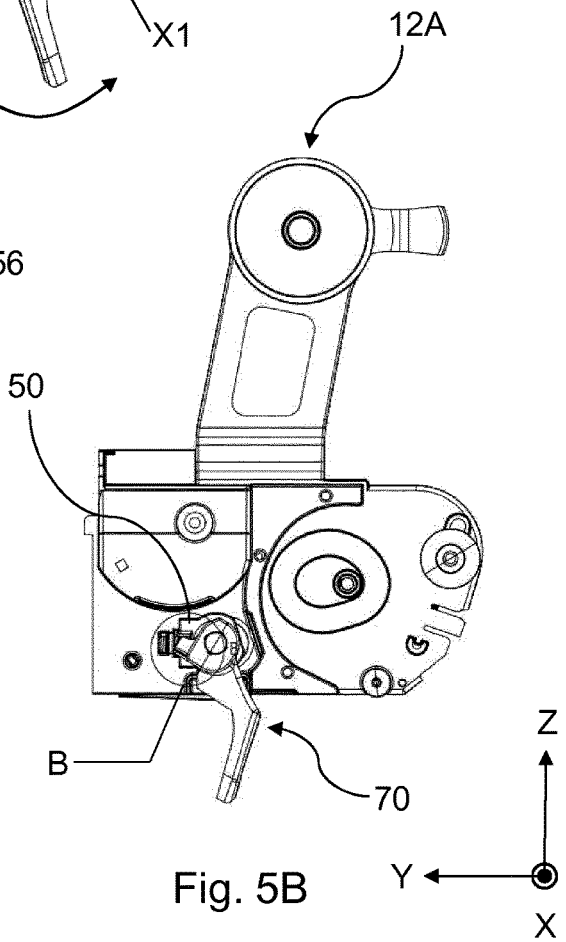
FIG. 5B is an opposite side view of the mechanism shown in FIG. 5A.

Mechanism 1 also includes a mobile member 50, which is clearly visible on FIGS. 4C and 5C, as well as an actuating member 70 configured to rotate about a rotation axis X1 (shown on FIG. 2) in a first direction R1 (shown on FIGS. 4A and 5A), through manual actuation by a user. For instance, the rotation axis X1 may take the form of a pivot rigidly coupled to the mobile member 50 in movement (by integrally forming the pivot with the mobile member 50 or, alternatively, by rigidly attaching the pivot and the mobile member 50 to one another). Alternatively, the rotation axis X1 may be movably mounted on the mobile member 50, in particular pivotably mounted on the mobile member 50.

Also, in this example, the actuating member 70 includes a push bar 72 arranged to be pushed by the user in order to rotate the actuating member 70 in the first direction R1. However, without departing from the scope of the present disclosure, the actuating member 70 may be provided with a different arrangement, such as a lever or a rotatable crank.

In addition, the mechanism 1 has a driver member 90 coupled with the actuating member 70. In this example, the driver member 90 and the actuating member 70 are rigidly coupled to one another in movement, and more specifically in rotation. It is understood, without departing from the scope of the present disclosure, that the driver member 90 and the actuating member 70 may alternatively be coupled to one another in movement, particularly in rotation, in such a manner than so as to allow relative movement with respect to each other. Also, in this example, the driver member 90 and the actuating member 70 are formed as separate elements attached to each other. However, they may alternatively be integrally formed as a single element without departing from the scope of the present disclosure.

Moreover, in this example, the driven member 30 includes a first gear member, the driver member 90 includes a second gear member, and the driven and driver members are respectively connected to and disconnected from one another through a meshing engagement movement and a meshing disengagement movement of the second gear member relative to the first gear member. However, without departing from the scope of the present disclosure, the driven and driver members may be arranged differently, provided that their respective shapes are suitable for allowing and preventing motion transmission from the driver member to the driven member by respectively connecting and disconnecting from each other through relative displacements.

Furthermore, in this example, the rotation axis X1 is movably mounted on the frame member 10 through the mobile member 50. To be more specific, the mobile member 50 is movably mounted on the frame member 10 so as to allow movement of the rotation axis X1 between a first position P1 (shown in FIG. 3) and a second position P2 (shown in FIG. 5A). In the first position P1 the driver member 90 and the driven member 30 are connected to one another so as to allow rotation of the roller 130 caused by rotation of the actuating member in the first direction R1. In the second position P2 the driver member 90 and the driven member 30 are disconnected from one another, which is effective to prevent rotation of the roller 130 caused by rotation of the actuating member 70 in the first direction R1 (FIG. 4A).

More specifically, in this example, the mobile member 50 is slidably movable to allow the rotation axis X1 to slidably move between the first and second positions P1, P2. However, without departing from the scope of the present disclosure, the mobile member 50 may alternatively be movably mounted on the frame member 10 so as to follow a different trajectory, such as rotation or a more complex trajectory. Also, in this example and as shown on FIGS. 4C and 5C, the sliding arrangement is achieved by providing one of the mobile member 50 or frame member 10 with a guided portion 52, and the other one of the mobile member 50 or frame member 10 is provided with a guiding portion 12 configured to cooperate with the guided portion 52 to guide movement of the mobile member 50 between the first and second positions P1, P2. In the illustrated embodiment, mobile member 50 has a guided portion 52, while frame member 10 has a guiding portion 12.

In addition, in this example, the rotation axis X1 is arranged to move between the first and second positions P1, P2 along a trajectory contained in a plane YZ perpendicular to the orientation of the rotation axis X1 in the first position P1. More specifically, this trajectory is linear in the present example, as a result of the sliding arrangement described above. Also, in this example, the rotation axis X1 of the actuating member 70 is configured to be oriented along a direction X perpendicular to a dispensing direction, along which a user can grab the material and pull it in order to dispense a sheet. Also, in this example, the rotation axis X1 is configured to be oriented parallel to a rotation axis of the roller 130. Further, in this example, the rotation axis X1 is configured to be oriented parallel to a rotation axis of a roll 200, when the roll 200 is incorporated into the dispenser 100. However, the present disclosure is not limited to these particular relative orientations of the rotation axis X1, so that the latter may be oriented so as to achieve only part or none of these particular relative orientations. In addition, since the actuating member 70 and the driver member 90 are rigidly coupled to one another in rotation (in this particular example), the rotation axis X1 of the actuating member 70 is also a rotation axis of the driver member 90.

Furthermore, in this example, the first and second positions P1, P2 are respectively defined by the distance, in the plane YZ and along a direction Y intended to be horizontal when the dispenser 100 is in use, which separates the rotation axis X1 of the actuating member 70 from the rotation axis of the driven member 30. Also, by comparing the difference between the first and second positions P1, P2 shown on FIGS. 3 and 5A, in combination with the difference of position of the actuating member 70, it can be seen that, in this example, the first position P1 is arranged to be closer to the driven member 30 than is the second position P2, and the actuating member 70 is arranged to rotate away from the driven member 30 when rotating in the first direction R1.

In addition, as shown on FIGS. 4C and 5C, the mechanism 1 has a first urging member configured to urge the mobile member 50 in the first position P1. More specifically, in this example, the first urging member includes a single spring 20, which could for example be in the form of a metallic spring. Furthermore, in this example, the spring 20 includes a first end 24 arranged to contact a surface 14 of the frame member 10, and a second end 26 arranged to contact a surface 56 of the mobile member 50 (see FIGS. 4C and 5C). Alternatively, without departing from the scope of the present disclosure, another number of springs, such as two or more than two, may be provided. In particular, these at least two springs 20 may be provided spaced apart along the direction X defined by the rotation axis X1 of the actuating member 70, in order to respectively urge the rotation axis X1 at least two respective points, which are spaced apart along direction X. This configuration allows for a balanced distribution of the stress applied on the rotation axis X1.

Also, in this example, the spring 20 is in the form of a compression spring configured to be compressible along a direction Y, which is perpendicular to the direction X of the rotation axis X1, and which is tangent to the portion of circle that is described by the rotational movement of a given point of the actuating member 70 when the latter is rotated. However, within the scope of the present disclosure, the spring 20 is not limited to a compression spring and may have a variety of other designs. For instance, in addition to or alternatively to a compression, the spring 20 may be arranged to exert an urging force through an extension and/or a torsion and/or another kind of deformation of the spring 20. In particular, the spring 20 may be an extension spring, a torsion spring, or a spring with another design.

In addition, in this example, the first urging member is arranged to exert an urging force on the mobile member 50 so as to indirectly urge the rotation axis X1 in the first position P1. However, without departing from the scope of the present disclosure, the first urging member may alternatively exert an urging force directly on the rotation axis X1 so as to urge the rotation axis X1 in the first position P1, or on the driver member 90 or the actuating member 70 so as to indirectly urge the rotation axis X1 in the first position P1.

Figure 3:
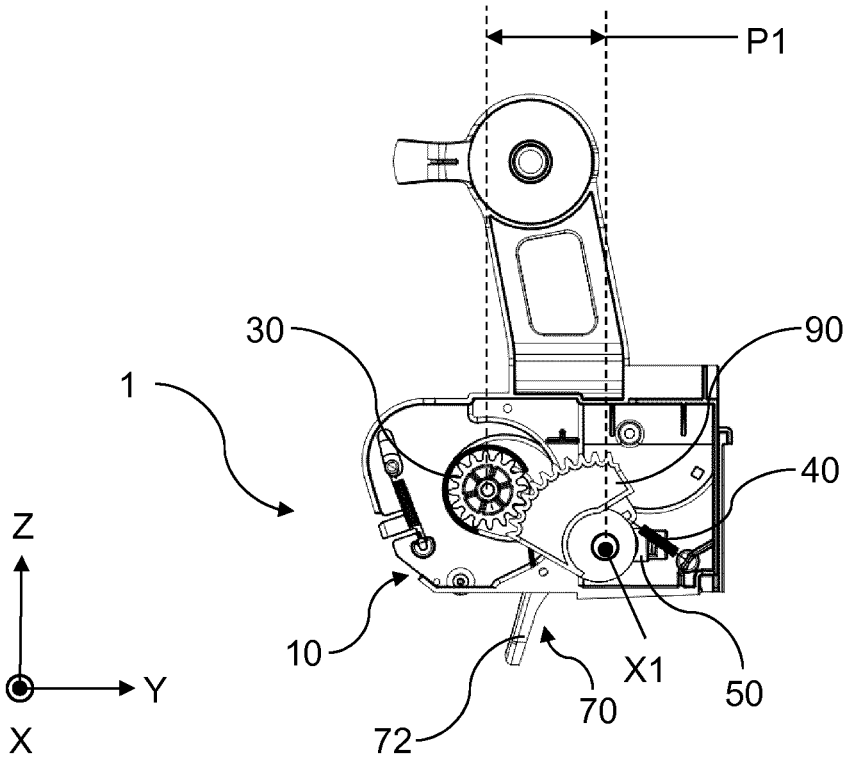
FIG. 3 is a side view of the mechanism of FIG. 2, showing the actuating member thereof in a rest position.

Moreover, as shown on FIGS. 3 and 4A, the mechanism 1 includes a second urging member distinct from the first urging member and configured to urge the actuating member 70 in a second direction of rotation opposite the first direction RE More specifically, in this example, the second urging member includes a single spring 40, which could be a metallic spring or some other type of spring. Furthermore in this example, spring 40 is in the form of an extension spring. Alternatively, without departing from the scope of the present disclosure, another number of springs, such as two or more than two, may be provided. Also, within the scope of the present disclosure, the spring 40 is not limited to an extension spring and may have a variety of other designs. For instance, in addition to or alternatively to an extension, the spring 40 may be arranged to exert an urging force through a compression and/or a torsion and/or another kind of deformation of the spring 40. In particular, the spring 40 may be a compression spring, a torsion spring, or a spring with another design.

In addition, in this example, the second urging member is configured to directly urge the actuating member 70 in the second direction of rotation. However, without departing from the scope of the present disclosure, the second urging member may alternatively be arranged to urge the driver member 90 or the rotation axis X1 so as to indirectly urge the actuating member 70 in the second direction of rotation.

In addition, a dispenser including a mechanism 1 according to the first embodiment may be operated as follows. Various situations can arise where it is desirable to manually actuate rotation of the roller 130 for dispensing a predetermined length of sheet material contained in the dispenser. For example, when a paper jam, a load of an excessive wad of paper or other sources of blocking within the dispenser occur, the sheet material is likely to tear inside the housing of the dispenser, instead of being accessible to the user. Also, when the dispenser is arranged to be automatically operated during normal operation, for instance by providing the dispenser with an electrical device, a situation can arise where this automatic operation cannot be achieved so that a tail of the sheet material is likely to be confined inside the housing of the dispenser.

In these situations, the user can manually actuate the actuating member 70 in order to rotate the actuating member 70 in the first direction R1, from an initial position of the actuating member that allows a rotation of the actuating member 70 in the first direction R1. When a second urging member is provided, this initial position may be a rest position toward which the second urging member urges the actuating member 70. In this case, when the user causes a rotation of the actuating member 70 in the first direction R1 through his manual actuation of the actuating member 70, the second urging member urges the actuating member 70 in the second direction of rotation opposite the first direction R1, for instance through deformation when the second urging member includes at least one spring 40.

When the force exerted by the user on the actuating member 70 does not overcome the urging force exerted by the first urging member, that is, during normal actuation of the actuating member 70, the rotation axis X1 is forced to remain in the first position P1 by the first urging member, so that the driver member 90 and the driven member 30 are connected to one another, thereby causing rotation of the roller 130 as the actuating member 70 rotates in the first direction R1. This rotation of the roller 130 causes dispensing of certain length of sheet material. After that operation, the user can stop exerting a force on the actuating member 70, which is then automatically returned in the rest position by the second urging member.

Conversely, when the force exerted by the user on the actuating member 70 overcomes the urging force exerted by the first urging member, that is, when an excessive load is applied on the mechanism, the rotation axis X1 is moved from the first position P1 to the second position P2 against the urging force of the first urging member (for instance through deformation of the first urging member, when the first urging member includes at least one spring 20), which causes a disconnection of the driver member 90 and the driven member 30 from one another, thereby preventing rotation of the roller 130 during rotation of the actuating member 70 in the first direction R1. When the user stop exerting a force on the actuating member 70, the rotation axis X1 is automatically returned in the first position P1 by the first urging member, and the actuating member 70 is automatically returned in the rest position by the second urging member.

Second Embodiment

Figure 6A:
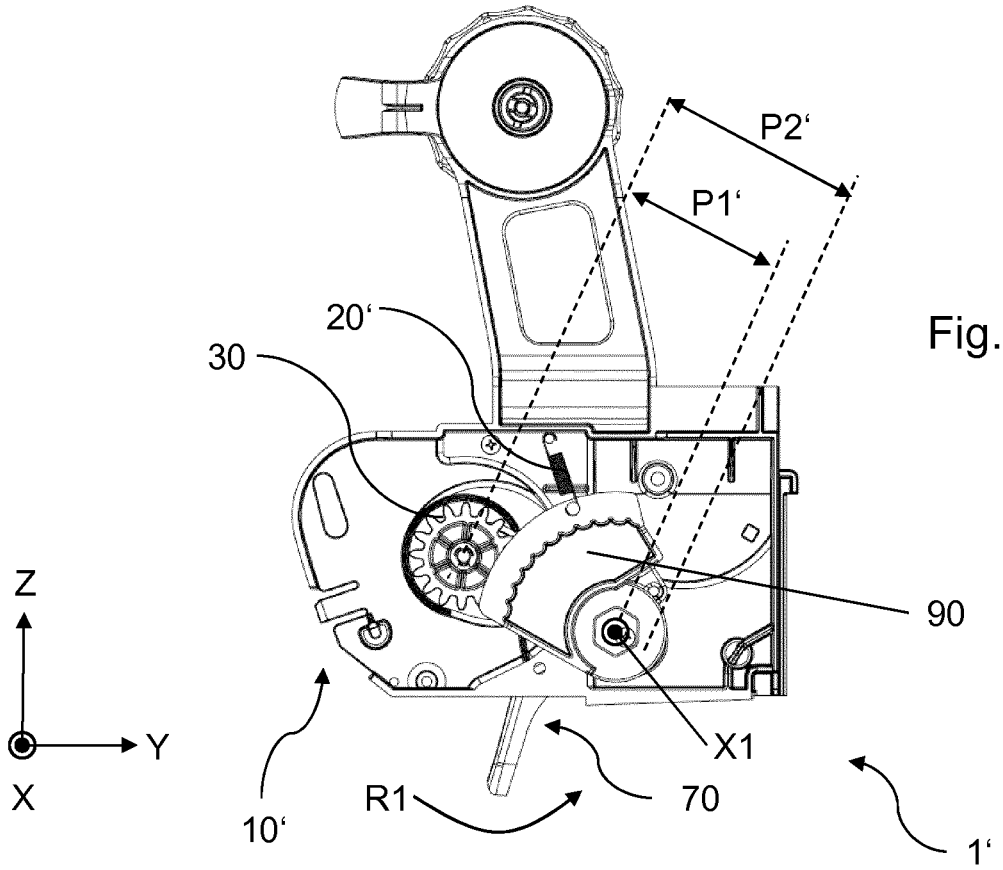
FIG. 6A is a side view of a mechanism for a dispenser according to a second embodiment.
Figure 6B:
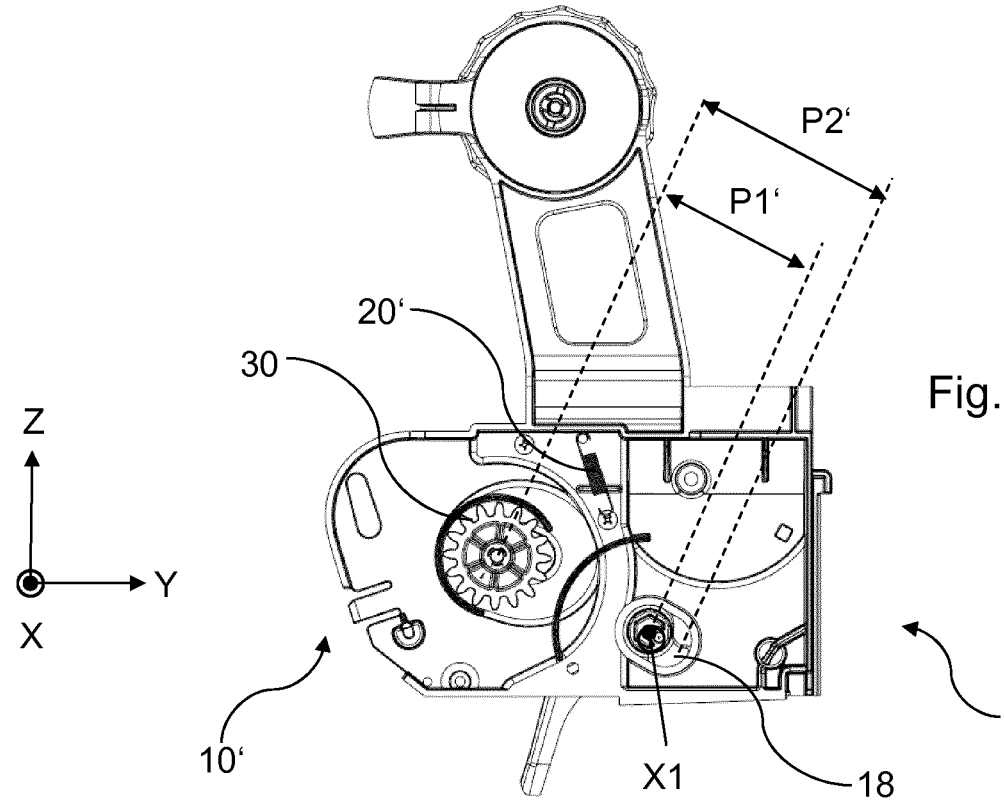
FIG. 6B is a side view similar to FIG. 6A, with the actuating member and driver member removed.

FIGS. 6A and 6B schematically illustrate a mechanism 1' for a dispenser according to a second embodiment of the present disclosure. In this example, this mechanism 1' is similar in features to the one described in the first embodiment, except for the features described hereunder.

In the second embodiment, unlike the first embodiment, the rotation axis X1 is movably mounted directly on the frame member 10'. More specifically, in the second embodiment, the rotation axis X1 takes the form of a pivot movably mounted in a moving path of the frame member 10' so as to be movable between first and second positions P1', P2'. In the first position P1' the driver member 90 and the driven member 30 are connected to one another so as to allow rotation of the roller 130 caused by rotation of the actuating member in the first direction R1. In the second position P2' the driver member 90 and the driven member 30 are disconnected from one another, which is effective to prevent rotation of the roller 130 caused by rotation of the actuating member 70 in the first direction R1. However, without departing from the scope of the present disclosure, the moving path may be included in a mobile member movably mounted on the frame member so as to allow movement of the rotation axis X1 between the first and second positions P1', P2'.

In the second embodiment, the rotation axis X1 is slidably movable between the first and second positions P1', P2'. In this example, the moving path of the frame member 10' has a linear path in which the rotation axis X1 is slidably movable between the first and second positions P1', P2'. To be more specific, in the second embodiment, the moving path is formed by an elongated opening, slot, recess or the like (in particular an elongated slot 18 as shown on FIG. 6B) of the frame member 10', in particular one having a linear portion defining the linear path.

In the second embodiment, the rotation axis X1 is rigidly coupled in movement, and more specifically in rotation, with the actuating member 70. However, without departing from the scope of the present disclosure, the rotation axis may be coupled with the actuating member so as to allow movement, such as rotation, relative to one another.

In addition, unlike the first embodiment, the mechanism according to the second embodiment is arranged so that the first and second positions P1', P2' are respectively defined by the distance, in the plane YZ and along a direction oblique to direction Y, which has been described in more detail in relation with the first embodiment, and whose description is omitted here for the sake of conciseness. For example, the linear path, and more specifically the linear portion may have a direction oriented along that direction oblique.

Moreover, unlike the first embodiment, the mechanism according to the second embodiment is configured so that the first urging member is arranged to exert an urging force on the driver member 90 so as to indirectly urge the rotation axis X1 in the first position P1'. However, without departing from the scope of the present disclosure, the first urging member may alternatively exert an urging force directly on the rotation axis X1 so as to urge the rotation axis X1 in the first position P1', or on the actuating member 70 so as to indirectly urge the rotation axis X1 in the first position P1'. More specifically, the first urging member includes a single spring 20', which could be a metallic spring or some other type of spring. Furthermore in this example, spring 20' is in the form of an extension spring. Alternatively, without departing from the scope of the present disclosure, another number of springs, such as two or more than two, may be provided. Also, within the scope of the present disclosure, the spring 20' is not limited to an extension spring and may have a variety of other designs. For instance, in addition to or alternatively to an extension, the spring 20' may be arranged to exert an urging force through a compression and/or a torsion and/or another kind of deformation of the spring 20'. In particular, the spring 20' may be a compression spring, a torsion spring, or a spring with another design.

In addition, unlike the first embodiment, the first urging member of the second embodiment (and more specifically the spring 20') is further configured to urge the actuating member 70 in a second direction of rotation opposite the first direction R1. Thus, in addition to being configured to urge the rotation axis X1 in the first position P1', the first urging member can simultaneously perform a second function of urging the actuating member to return to a rest position.

Exception made of the differences developed above, the second embodiment may have features similar to those of the first embodiment. Description of these features in relation with the second embodiment is omitted for the sake of conciseness. However, within the scope of the present disclosure, these features have to be considered as also disclosed in combination with the second embodiment.

In addition, a dispenser including a mechanism 1' according to the second embodiment may be operated in a manner similar as the one described in relation with the first embodiment, exception made that the urging functions of the first and second urging members described in the first embodiment are simultaneously achieved by a single urging member (for instance a single spring 20') in the second embodiment.

The embodiments described above are only descriptions of preferred embodiments of the present invention, and are not intended to limit the scope of the present invention. Various variations and modifications can be made to the technical solution of the present invention by those of ordinary skills in the art, without departing from the design of the present invention. The variations and modifications should all fall within the claimed scope defined by the claims of the present invention.

What is claimed is:

1. A mechanism for manually actuating rotation of a roller of a sheet material dispenser for dispensing a predetermined length of sheet material, said mechanism comprising:

a frame member configured for attachment to a housing of the dispenser;

a driven member configured for coupling with the roller;

an actuating member configured to rotate about a rotation axis in a first direction through manual actuation by a user;

a driver member coupled with the actuating member;

wherein the rotation axis is movably mounted on the frame member so as to be movable between a first position in which the driver member and the driven member are connected to one another to allow rotation of the roller caused by rotation of the actuating member in the first direction, and a second position in which the driver member and the driven member are disconnected from one another to prevent rotation of the roller caused by rotation of the actuating member in the first direction, and wherein the mechanism comprises a first urging member configured to urge the rotation axis in the first position.

2. The mechanism of claim 1, wherein the rotation axis is movably mounted directly on the frame member.

3. The mechanism of claim 2, wherein:

the rotation axis is slidably movable between the first and second positions, the rotation axis is arranged to move between the first and second positions along a trajectory contained in a plane perpendicular to an orientation of the rotation axis in the first position, the first position is arranged to be closer to the driven member than is the second position, and wherein the actuating member is arranged to rotate away from the driven member when rotating in the first direction, the first urging member comprises at least one spring, the driven member comprises a first gear member, wherein the driver member comprises a second gear member, and wherein the driven member and driver member are respectively connected to and disconnected from one another through a meshing engagement movement and a meshing disengagement movement of the second gear member relative to the first gear member, the driver member and the actuating member are rigidly coupled to one another in rotation, the driver member and the actuating member are formed as separate elements or are integrally formed as a single element, and the first urging member is further configured to urge the actuating member in a second direction of rotation opposite the first direction.

4. The mechanism of claim 1, comprising a mobile member through which the rotation axis is movably mounted on the frame member.

5. The mechanism of claim 4, wherein one of the mobile member and frame member comprises a guided portion, and the other one of the mobile member and frame member comprises a guiding portion configured to cooperate with the guided portion to guide movement of the mobile member between the first and second positions.

6. The mechanism of claim 5, wherein:

the rotation axis is slidably movable between the first and second positions, the rotation axis is arranged to move between the first and second positions along a trajectory contained in a plane perpendicular to an orientation of the rotation axis in the first position, the first position is arranged to be closer to the driven member than is the second position, and wherein the actuating member is arranged to rotate away from the driven member when rotating in the first direction, the first urging member comprises at least one spring, the at least one spring includes a first end arranged to contact a surface of the frame member, and a second end arranged to contact a surface of the mobile member, the driven member comprises a first gear member, wherein the driver member comprises a second gear member, and wherein the driven member and driver member are respectively connected to and disconnected from one another through a meshing engagement movement and a meshing disengagement movement of the second gear member relative to the first gear member, the driver member and the actuating member are rigidly coupled to one another in rotation, the driver member and the actuating member are formed as separate elements or are integrally formed as a single element, the first urging member is further configured to urge the actuating member in a second direction of rotation opposite the first direction, and the mechanism further comprising a second urging member distinct from the first urging member and configured to urge the actuating member in a second direction of rotation opposite the first direction.

7. The mechanism of claim 1, wherein the rotation axis is slidably movable between the first and second positions.

8. The mechanism of claim 1, wherein the rotation axis is arranged to move between the first and second positions along a trajectory contained in a plane perpendicular to an orientation of the rotation axis in the first position.

9. The mechanism of claim 1, wherein the first position is arranged to be closer to the driven member than is the second position, and wherein the actuating member is arranged to rotate away from the driven member when rotating in the first direction.

10. The mechanism of claim 1, wherein the first urging member comprises at least one spring.

11. The mechanism of claim 10, wherein the at least one spring includes a first end arranged to contact a surface of the frame member, and a second end arranged to contact a surface of a mobile member through which the rotation axis is movably mounted on the frame member.

12. The mechanism of claim 1, wherein the driven member comprises a first gear member, wherein the driver member comprises a second gear member, and wherein the driven member and driver member are respectively connected to and disconnected from one another through a meshing engagement movement and a meshing disengagement movement of the second gear member relative to the first gear member.

13. The mechanism of claim 1, wherein the driver member and the actuating member are rigidly coupled to one another in rotation.

14. The mechanism of claim 1, wherein the driver member and the actuating member are formed as separate elements.

15. The mechanism of claim 1, wherein the driver member and the actuating member are integrally formed as a single element.

16. The mechanism of claim 1, comprising a second urging member distinct from the first urging member and configured to urge the actuating member in a second direction of rotation opposite the first direction.

17. The mechanism of claim 1, wherein the first urging member is further configured to urge the actuating member in a second direction of rotation opposite the first direction.

18. An assembly comprising:

a roller; and the mechanism of claim 1.

19. A sheet material dispenser comprising:

a housing;

a roller; and the mechanism of claim 1.

* * * * *